US005179250A

United States Patent [19]

Campoli

[11] Patent Number: 5,179,250

[45] Date of Patent: Jan. 12, 1993

[54] SEGMENTED CARTRIDGE ASSEMBLY

[75] Inventor: Ralph F. Campoli, Mine Hill, N.J.

[73] Assignee: Olin Corporation, Cheshire, Conn.

[21] Appl. No.: 816,003

[22] Filed: Jan. 2, 1992

Related U.S. Application Data

[63] Continuation-in-part of Ser. No. 773,758, Oct. 11, 1991, which is a continuation of Ser. No. 429,461, Oct. 19, 1989, abandoned.

[51] Int. Cl.[5] ..... F42B 5/16; F42B 5/00

[52] U.S. Cl. ..... 102/443; 102/430; 102/431; 102/464

[58] Field of Search ..... 102/202, 204, 331, 430, 102/431, 433, 434, 439, 443, 464, 469, 470, 472

[56] References Cited

U.S. PATENT DOCUMENTS

| | | | |
|---|---|---|---|
| 352,125 | 11/1886 | Graydon . | |
| 420,623 | 2/1890 | Holland . | |
| 3,547,030 | 12/1970 | Kamp . | |
| 3,696,749 | 10/1972 | Scanlon . | |
| 4,458,597 | 7/1984 | Reynes . | |
| 4,572,076 | 2/1986 | Politzer | 102/431 |
| 4,682,545 | 7/1987 | Jett, Jr. . | |
| 4,742,773 | 5/1988 | Bartholomew et al. . | |
| 4,763,577 | 8/1988 | Romer et al. . | |
| 4,771,694 | 9/1988 | Bartholomew et al. . | |
| 4,917,017 | 4/1990 | Beltz . | |
| 4,936,220 | 6/1990 | Burns et al. . | |
| 5,090,323 | 2/1992 | Kallevig et al. | 102/430 |

FOREIGN PATENT DOCUMENTS

| | | | |
|---|---|---|---|
| 24419 | 5/1936 | Australia . | |
| 314547 | 5/1989 | European Pat. Off. | 102/443 |
| 288564 | 4/1920 | Fed. Rep. of Germany . | |
| 1082834 | 6/1960 | Fed. Rep. of Germany | 102/443 |
| 1256531 | 12/1959 | France . | |
| 550214 | 1/1958 | Italy | 102/464 |
| 157600 | 6/1990 | Japan | 102/443 |
| 16652 | 8/1907 | Norway | 102/430 |
| 6548 | of 1890 | United Kingdom | 102/439 |

*Primary Examiner*—Harold J. Tudor
*Attorney, Agent, or Firm*—Bruce E. Burdick

[57] ABSTRACT

The cartridge assembly of the present invention comprises two or more combustible cartridge case segments, the front of which is fastened to the projectile assembly and the rear of which contains a primer assembly and a charge of propellant. The two segments are automatically joined together during loading into a gun chamber via velcro rings at a butted interface between the segments. Extending axially throughout each of the segments is a distributed plurality of flexible combustible ignition strands which, when ignited, propagate the ignition flame front at an extremely high rate, on the order of between 3 to 6 thousand feet per second, ensuring virtually simultaneous ignition of the propellant in each segment.

5 Claims, 2 Drawing Sheets

SEGMENTED CARTRIDGE ASSEMBLY

CROSS REFERENCE TO RELATED APPLICATION

This application is a continuation-in-part of U.S. Ser. No. 5,129,324, filed Oct. 11, 1991 which is a continuation of U.S. Ser. No. 07/429,461 filed Oct. 19, 1989, now abandoned. This application is also related to U.S. application Ser. No.07/644,726 filed Jan. 23, 1991, now U.S. Pat. No. 5,129,324, which is a divisional of U. S. application Ser. No. 07/429,461 filed Oct. 19, 1989 and U.S. application Ser. No. 07,803,806 filed Dec. 9, 1991.

BACKGROUND OF THE INVENTION

1. Field of the Invention

This application generally relates to cannon cartridges and more particularly to a cartridge assembly having multiple connected cases.

2. Brief description of the Related Art

Cannon cartridges, especially those designed for use in tank guns, are limited in the axial length which can be accommodated within the confines of the tank. This restriction limits the amount of propellant that can be utilized to propel a given projectile through the gun tube. Accordingly, there is a need for a cartridge design which extends the useful volume for containing propellant within the cartridge without lengthening the cartridge unit. One approach is to provide a portion of the propellant charge around the sabot of a penetrator projectile as disclosed in U.S. Pat. No. 4,936,220. This design makes use of the space between front and rear bourrelets to house a sequentially ignited booster charge However, the volume available for propellant is comparatively small. Another approach is to provide separate propellant and projectile components. In large artillery cannon designs, the propellant is loaded as separate canisters or bags behind the projectile. Thus the entire round to be fired consists of several unconnected components. This design has the advantage of being easily handled by those individuals loading the gun. This design also has the advantage that the total charge can be tailored to the target type and range on the spot. Such tailoring is not conventionally available lo lank guns.

Separate ammunition is also more time consuming to load than fixed ammunition. It has the additional disadvantage in that in order to unload an unfired round from the chamber of the gun, the operator must reach into the chamber, which may potentially be very hot, to retrieve the individual bags of propellant and the projectile.

Accordingly, there is a a continual need for a cartridge assembly for use in a large caliber tank gun which extends the propelling charge capacity. There is also a need for a cartridge assembly which permits on the spot selection of the propellant charge to be utilized depending on the target range and type. There is also a need for a cartridge assembly that is simple to load and permits retrieval of the round components easily by an individual operating the gun without reaching into the gun chamber to retrieve components.

SUMMARY OF THE INVENTION

The cartridge assembly in accordance with the present invention addresses the above mentioned needs. The cartridge assembly of the present invention comprises two or more combustible cartridge case segments, the front of which is fastened to the projectile assembly and the rear of which contains a primer assembly and a charge of propellant The two segments are automatically joined together during loading via velcro rings at a butted interface between the segments.

Velcro, as used in this specification, means a pair of complementary sheet or fabric materials, one of which has hooks and the other has loops or a thread pile which is engaged by the hooks when the two materials are placed together.

Extending axially throughout each of the segments is a bundle of flexible combustible ignition strands which, when ignited, propagate the ignition flame front at an extremely high rate, on the order of between 3 to 6 thousand feet per second.

In operation, the projectile containing segment is loaded first into the gun chamber followed by the primer containing propellant charge container. As the segments are butted together, the velcro strip hook and loop arrangement locks the two segments together forming an integral cartridge assembly which can easily be removed and separated from one another during unloading of the tank gun if necessary.

The rear segment of the cartridge assembly of the invention comprises a tubular combustible cartridge casing having a metal head closing one end. A combustible interface cap closes the other end. A plurality of ignition strands extend from the primer assembly mounted in the metal head, through the propellant contained in the case to a holding plug mounted in the combustible interface cap so that the ignition strands terminate flush with the outer surface of the holding plug. Around the plug on the front face of the interface cap is a ring of velcro type of material. This ring is preferably cemented onto the front face of the cap.

The velcro type material is typically one piece of a complementary pair of fabrics One of the pair has resilient hooks extending from a fabric backing which is glued or sewn to the end cap. The other of the pair has thread loops, or jumbled yarns forming loops attached to a fabric backing. The loops become hooked when the two materials are butted together.

The front segment comprises a combustible case, which is a tubular body, having an interface cap and plug assembly closing the rear end of the tubular body and a projectile assembly inserted into and closing the front end of the combustible case. Extending from the interface cap and plug assembly through the propellant charge contained in the case around the rear of the projectile assembly is a plurality of flexible combustible ignition strands as in the rear segment. Each strand has its front end secured in a corresponding blind bore in a sabot on the projectile assembly. The rear end of the strands extend into and through the holding plug so as to project flush with the aft end of the holding plug in the interface cap and plug assembly closing the rear end of the case. On the exterior aft face of the interface cap is a ring of velcro type fabric which is complementary to the velcro ring on the face of the interface cap on the front end of the rear segment.

When the two segments are butted together, as when the segments are inserted sequentially into the chamber of the gun, the ends of the strands butt against and the caps adhere to each other. The segments are thus joined, in effect, into one cartridge assembly. In addition, the propellant composition in the rear segment can be field selected to optimize the ballistic performance for a given target.

Upon ignition, the ignition flame front propagates at a high rate from the primer assembly along the ignition strand in the aft cartridge segment, through the plug assembly, across the abutted caps to the strands in the front segment, and then throughout the strands in the front segment. Since the ignition propagation velocity is on the order of between 3,000 to 6,000 feet per second, and each of the case segments are approximately 2.5 feet in length, propellant ignition in both segments occurs in less than a millisecond. Thus propellant ignition in both segments occurs virtually simultaneously. Since different propellant charges can be contained in the separate segments, the total charge utilized can be tailored to the specific target and range, much like separate ammunition in large artillery guns. This choice can now be made in the field with the use of the assembly in accordance with the invention.

These and other features, objects and advantages of the present invention will become readily apparent from a reading of the following detailed description when taken in conjunction with the appended claims and the accompanying drawing.

DETAILED DESCRIPTION OF THE INVENTION

Figure 1:
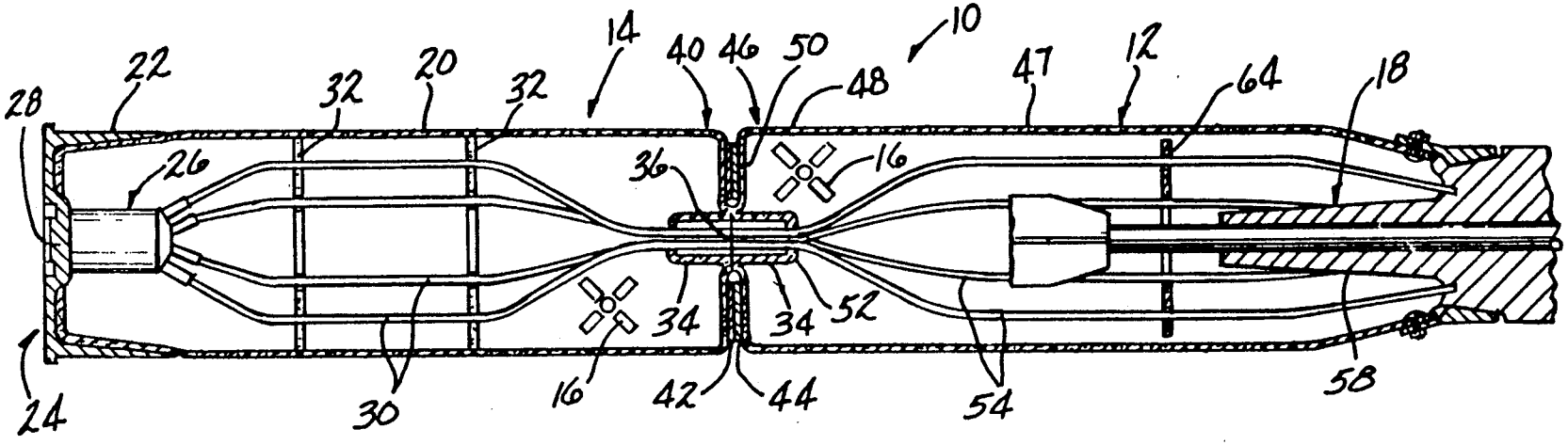
FIG. 1 is a longitudinal schematic sectional view through a dual cartridge assembly in accordance with the present invention.

One preferred embodiment of the cartridge assembly 10 in accordance with the present invention is illustrated schematically in FIG. 1. The assembly comprises a front projectile and propellant case segment 12 butted against a rear primer and propellant case segment 14. The segments are operably connected together at an interface and each segment contains a propellant charge 16. The front segment 12 contains and supports a projectile assembly 18.

The rear primer and propellant case segment 14 comprises a tubular combustible case 20 which is open at both ends. The rear end of case 20 is closed by a conventional flanged metal closure head 22 which is retained on the rear end of case 20 in a conventional manner via threads, adhesive, snap rings, or other conventional fastening means.

The metal head 22 includes a primer assembly 24 which confines the rear ends of a plurality of flexible ignition strands 26 within a primer chamber containing a conventional primer composition The primer assembly 24 in the cartridge of the present invention includes a multistrand igniter assembly 26 and a primer head 28. The primer head 28 is a threaded metal housing which contains a conventional priming element. The igniter assembly 26 includes a unitary adapter body which holds the rear ends of a plurality of ignition strands 30 in proximity to the discharge opening from the primer head so as to receive the spark from ignition of the priming composition. The primer head 28 and the igniter assembly 26 are threadably fastened together so as to sandwich the metal head 22 therebetween.

Preferably there are six ignition strands 30 which have their rear ends terminating together in the igniter assembly 26. The ignition strands 30 then fan out forwardly into an equally circumferentially spaced arrangement extending axially through the case 20. The strands 30 are flexible combustible ignition strands of ITLX type material preferably available from Atlas Powder Company. These strands have a high order propagation velocity of between about 3000 to 6000 feet per second when the rear 1.4 inches of the strands are confined in the assembly 26 during ignition. These strands are further described in U.S. Pat. No. 4,917,017.

One or more lateral strand supports 32 may be utilized to maintain the ignition strands 30 in an appropriately spaced configuration. These strand supports 32 in the rear case are typically flat, combustible, ring shaped plates which frictionally fit inside the case 20 and have spaced through holes to laterally support the strands from one another in the propellant 16.

The opposite ends of the ignition strands 30 are gathered together and pushed into a holding plug 34 so that the terminal ends of the strands 30 are even with the outer face 36 of the holding plug 34. This holding plug 34 is then inserted into a cup shaped retaining portion 38 of an end cap 40. The end cap 40 is made of a combustible felted material such as nitrocellulose as is the combustible case 20. The end cap 40 is preferably adhesively bonded to the open front end of case 20 after the case is filled with propellant 16.

Affixed to the flat outer annular end surface of the cap 40 around the outer face 36 of the holding plug 34 is a velcro hook or loop material 42. This ring of velcro hook or loop material 42 is designed to mate with and attach to a corresponding loop or hook ring 44 on the end cap 46 of the projectile and propellant case segment 12.

Figure 5:
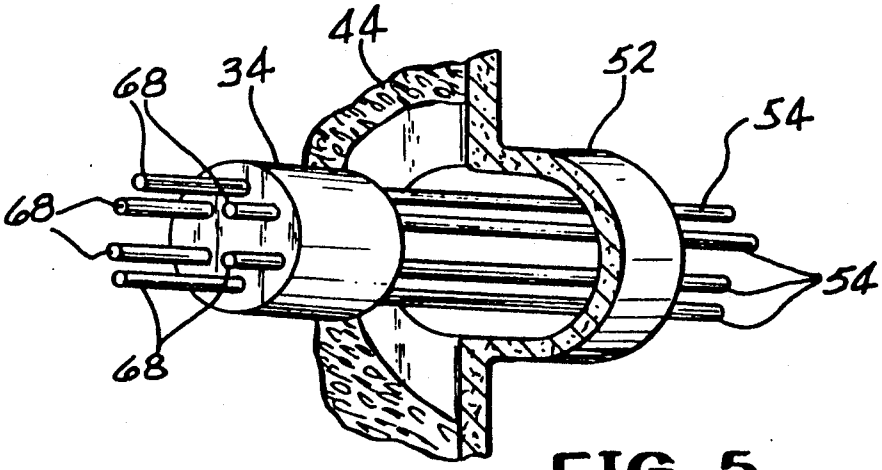
FIG. 5 is an enlarged exploded perspective view of the cap and plug assembly in accordance with the invention.
Figures 2, 3, 4:
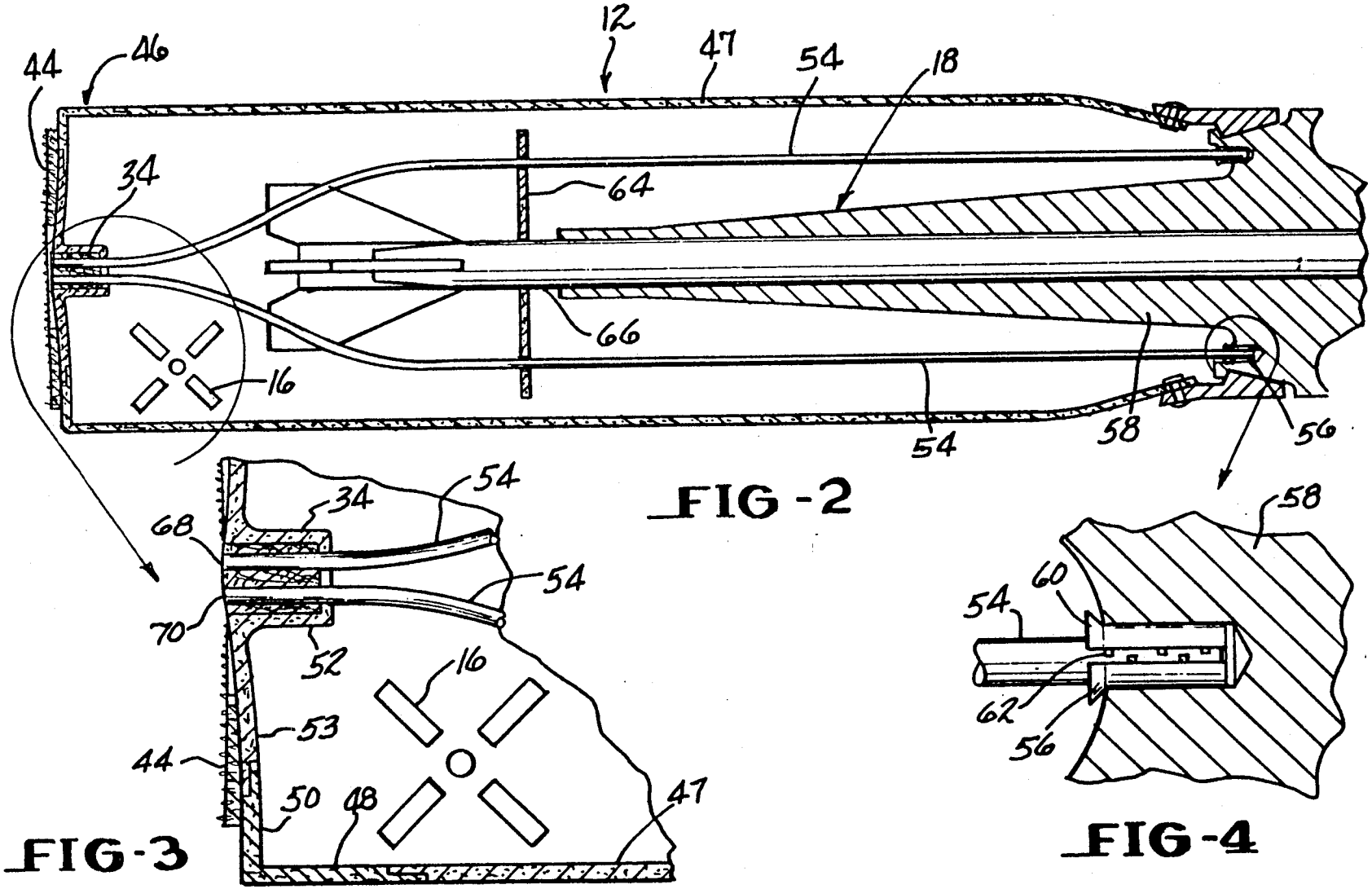
FIG. 2 is a longitudinal sectional view through the projectile and propellant segment in accordance with the present invention.
FIG. 3 is an enlarged partial sectional view of a rear portion of the segment shown in FIG. 2.
FIG. 4 is an enlarged view of the front end portion of the segment illustrated in FIG. 2.

The projectile and propellant case segment 12, separately shown in FIGS. 2 and enlarged portions shown in FIGS. 3, 4, and 5, comprises a tubular combustible case 47 having its rear end bonded to the end cap 46. The end closure cap 46 is essentially identical to the end cap 40 on the front end of the rear primer and propellant case segment 14. This end cap 46 is partially shown enlarged in FIG. 3.

The end cap 46 on case segment 12 has a tubular portion 48 which is coextensive from a flat annular disk portion 50 and a central cup shaped retainer portion 52 which supports another holding plug 34. This holding plug 34 Contains and supports the rear ends of another set of six ignition strands 54. The strands 54 extend forwardly through the propellant charge 16 contained within the segment 12 and terminate at the saboted projectile assembly 18 closing the front end of the segment 12.

The front ends of the ignition strands 54 are secured in holes 56 in the sabot 58 as is clearly shown in FIGS. 1, 2, and 4. The ends of the strands 54 are each pushed into a split sleeve 60 which has alternating teeth 62 along the split in the sleeve 60. The split sleeves 60 containing the ends of the ignition strands 54 are then inserted into the holes 56. The teeth 62 compressively bites into the plastic tubing of the ignition strand 54 to hold the strand end securely in place in the sabot 58.

As in the rear primer and propellant case segment 14, the strands 54 in the front projectile and propellant case segment 12 are maintained in lateral position by a strand support 64. Strand support 64 is a flat disk shaped piece of combustible material which is slidably disposed on the aft end of the finned penetrator 66. The strand support 64 has a plurality of radially extending fingers which each have a through bore through which an ignition strand 54 passes. The strand support 64 prevents lateral movement of the strands so as to keep the strands radially and circumferentially spaced within the assembly 12.

Assembly of front projectile and propellant case segment 12 proceeds as follows. The projectile assembly 18 is separately and conventionally assembled. The front ends of the ignition strands 54 are passed through the holes in the strand support 64 and embedded in the holes 56 in the sabot 58. If the projectile is a full caliber projectile rather than an saboted subcaliber kinetic energy penetrator projectile assembly as illustrated, then the ends of the strands 54 would be similarly embedded in holes in the aft end of the projectile itself.

The rear ends of the strands 54 are gathered and the outer case 47 of the front projectile and propellant case assembly 12 is then slid over the rear end of the projectile assembly 18 and the strands 54. The front end of the case 47 is rivited or otherwise secured to the projectile assembly 18.

The tubular portion 48 of the end cap 46 is preferably fastened to the aft end of the case 47 prior to installation on the projectile assembly 18. However, the portion 48 and the rear end of case 47 may be fastened together at this time. The joint is preferably glued with a suitable adhesive. The joint may be a typical skive joint or a rabbet as illustrated. The ends 68 of the ignition strands 54 are passed through a central aperture in the retainer portion 52. The outer annular rim 53 of the retainer portion 52 is adhesively bonded to the disk portion 50. The ends 68 are then threaded through the spaced bores 70 in the holding plug 34 and slack in the strands 54 is pulled through as the plug 34 is inserted into and seated in the retainer portion 52. The holding plug 34 may be friction fit or may be glued into the retainer portion 52. Finally, the ends 68 are cut off flush with the outer face 32 of the holding plug 30.

Assembly of the rear primer and propellant case segment 14 is similar and will therefore not be set forth in detail here. The principal difference is that the rear ends of the strands 30 are secured in the primer assembly 24, as is more fully described in copending application Ser. No. 07,803,806, assigned to the assignee of the present invention. The front ends of the strands 30 are secured in the cap 40 in a manner identical to that described above for cap 46.

In operation, front case segment 12 and rear case segment 14 are fastened together merely by contact between the end caps having the velcro materials 42 and 44 thereon. When the front projectile and propellant case segment 12 is loaded into a gun chamber followed by a rear primer and propellant case segment 14, a removable bond between the two cases is automatically established.

The outer end faces of the abutting holding plugs 30 need not be aligned such that the strands 30 and 54 match end to end. The propagation velocity of the flame front through the ignition strands 30 is strong enough and fast enough so that any mismatch between the ends of the ignition strands in the abutting holding plugs is inconsequential. The flame front merely traverses the interface between the case components instantaneously. In fact, the plugs 34 need not be touching one another but must be close enough so that traversal is assured. This distance is on the order of less than 0,25 inches.

The plugs 34 are presently made of wood. However, other materials may be advantageously employed, such as a cellulose fiber material, nitrocellulose, a plastic material, or a molded solid propellant. The end cap and plug assemblies 40 and 46 may also be made as a unitary molded body rather than the three piece design of combustible case material as above described. In this case, an energetic or at least combustible plastic material would be preferred.

The invention has been shown and described with reference to one preferred embodiment. Variations and modifications are contemplated as being within the scope of the invention as above described. In addition, other modifications are contemplated. For example, three or more segments may be joined together as above described. The rear segment 14 may have a noncombustible case. Also, there may be fewer or more ignition strands than the six illustrated in the above embodiment. The mechanism for joining the segments may also be other than velcro rings as above described. For example, a snap fit mechanical arrangement could be utilized. Accordingly it is intended to embrace all such variations and modifications as defined by the scope of the appended claims. All patents, patent applications and other references referred to herein are hereby incorporated by reference in their entirety.

What is claimed is:

1. A cartridge assembly comprising:

at least two tandemly arranged segments each containing a portion of a propellent charge;

one of said segments comprising a projectile assembly at a front end thereof and a first end cap at its opposing end;

another one of said segments comprising a primer at a rear end of said another segment and a second end cap at its opposing end;

said segments each containing ignition means for transmitting an ignition flame from said primer through said propellant charge and between said segments, each of said end caps comprising a combustible plug having bores therethrough receiving and retaining a portion of said ignition means in a fixed position so that said portion of said ignition means in said bores in said plugs in said front and rear segment end caps are abutted together; and complementary hook and loop fastener fabric members adhered to said end caps separably connecting said segments together at said end caps.

2. The assembly according to claim 1 further wherein said ignition means further comprises a multistrand igniter assembly having a plurality of flexible combustible ignition strands operably coupled to said primer in said rear segments.

3. The assembly according to claim 2 wherein said ignition means in said front segment contains a plurality of flexible ignition strands distributed through said propellant charge portion contained therein.

4. A cartridge assembly comprising:

at least two tandemly arranged segments each containing a portion of a propellant charge;

one of said segments comprising a projectile assembly at a front end thereof, a first end cap at its opposing end and a plurality of flexible ignition strands distributed through said propellant charge portion contained therein;

another one of said segments comprising a primer at a rear end of said another segment and a second end cap at its opposing end and a multistrand igniter assembly having a plurality of flexible combustible ignition strands operably coupled to said primer in said rear of said another segment; and releasable joining means for separably connecting said segments together at said end caps, said end cap on each segment containing a cylindrical combustible plug having bores therethrough receiving and retaining free ends of said plurality of igniter strands embedded in said propellant portion in said segment in a fixed relation so that said free ends are adjacent other free ends of igniter strands when said segments are positioned with said end caps abutting one another.

5. A cartridge assembly comprising:

a front tubular segment comprising a projective assembly closing a front end of said front segment and an end cap closing a rear end of said segment, said segment containing a portion of a propellant charge;

a rear tubular segment comprising an end cap closing a front end of said rear segment and a metal case head containing a primer closing a rear end of said rear segment, said rear segment containing another portion of said propellant charge;

said segments each containing ignition means for transmitting an ignition flame from said primer through said propellant charge and between said segments, each of said end caps comprising a separate combustible plug therein having bores therethrough receiving and retaining a portion of said ignition means in a fixed position so that said portions of said ignition means in said bores in said plugs in said front and rear segment end caps are abutted together.

* * * * *

UNITED STATES PATENT AND TRADEMARK OFFICE

CERTIFICATE OF CORRECTION

PATENT NO. : 5,179,250

DATED : January 12, 1993

INVENTOR(S) : Ralph F. Campoli

It is certified that error appears in the above—identified patent and that said Letters Patent is hereby corrected as shown below:

In column 8, line 2 after "a" insert -- projectile -- and delete "projective"

Signed and Sealed this

Twenty-third Day of November, 1993

*Attest:*

Bruce Lehman

BRUCE LEHMAN

*Attesting Officer*

*Commissioner of Patents and Trademarks*